United States Patent [19]

Bachmann

[11] Patent Number: 4,585,538

[45] Date of Patent: Apr. 29, 1986

[54] METHOD AND APPARATUS OF CLEANING RESIDUAL ANODES EMPLOYED FOR FUSED-SALT ELECTROLYSIS

[75] Inventor: Helmut Bachmann, Dinslaken-Hiesfeld, Fed. Rep. of Germany

[73] Assignee: Kaiser Aluminium Europe Inc., Dusseldorf, Fed. Rep. of Germany

[21] Appl. No.: 638,891

[22] Filed: Aug. 8, 1984

[30] Foreign Application Priority Data

Aug. 17, 1983 [DE] Fed. Rep. of Germany ..... 3329736

[51] Int. Cl.[4] ..... C25C 3/14; C25C 3/10; B02C 17/00

[52] U.S. Cl. ..... 204/225; 204/245; 241/170

[58] Field of Search ..... 204/67, 243 R–247, 204/225; 241/170

[56] References Cited

U.S. PATENT DOCUMENTS

| | | | |
|---|---|---|---|
| 4,119,505 | 10/1978 | Baillot et al. | 204/67 |
| 4,469,281 | 4/1984 | Roed | 204/67 |
| 4,510,033 | 4/1985 | Martin et al. | 204/245 |

*Primary Examiner*—Donald R. Valentine

*Attorney, Agent, or Firm*—Hopgood, Calimafde, Kalil, Blaustein & Judlowe

[57] ABSTRACT

For cleaning purposes, residual anodes obtained in fused-salt electrolysis are rotated and exposed to a flow of striker bodies which knock the bath material off the residual anode. To this end it is particularly recommended to pivot the residual anode from a vertically suspended position to an inclined pivoted position, in which free-falling striker bodies strike the anode with sufficient force and clean the same.

10 Claims, 1 Drawing Figure

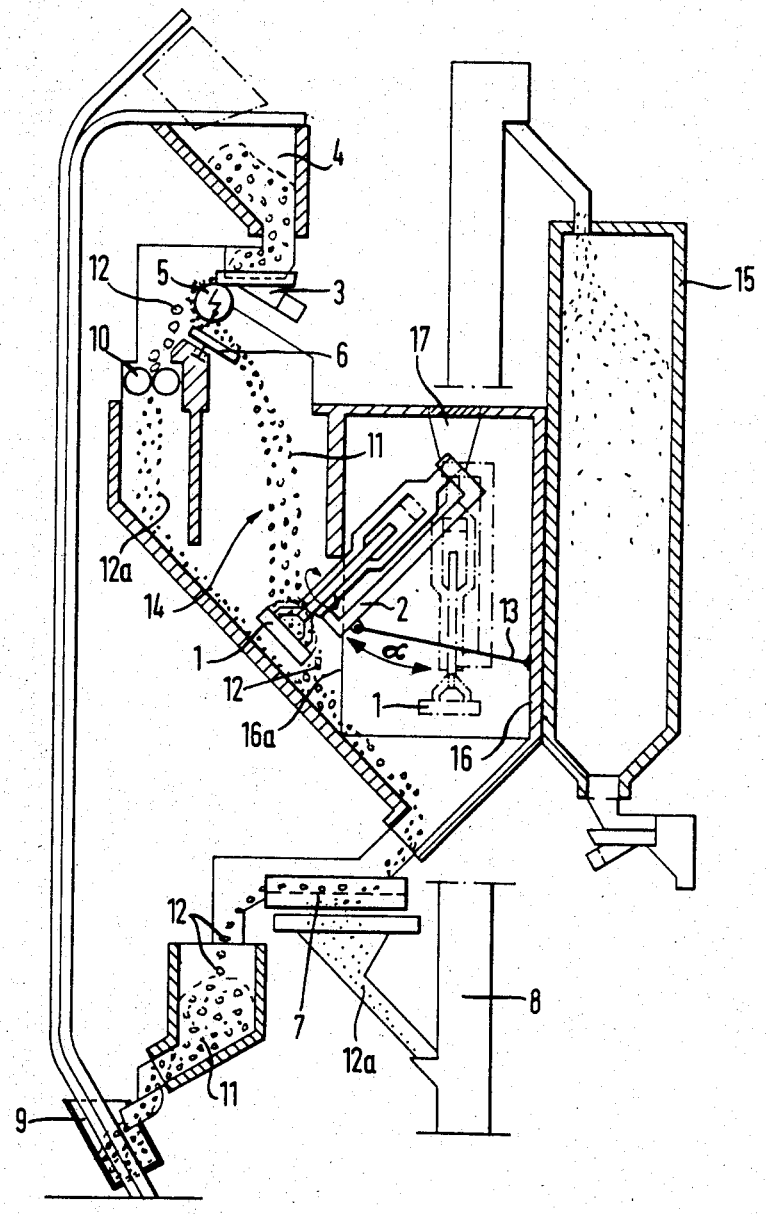
4
12
5
3
15
10
6
17
11
12a
14
2
13
1
α
12
1
16a
16
12
8
7
12a
11
9

METHOD AND APPARATUS OF CLEANING RESIDUAL ANODES EMPLOYED FOR FUSED-SALT ELECTROLYSIS

The invention is directed to a method and an apparatus of cleaning residual anodes employed especially for fused-salt electrolysis of aluminium.

In fused-salt electrolysis, a molten bath is produced by means of electrical current; the electrolytic cells are provided with anodes and cathodes. Due to wear the anodes have to be replaced from time to time. It has been known in this connection to roughly pre-clean the residual anodes directly above the electrolytic cell or furnace, respectively, by manually loosening the bath material, which is caked to the residual anode and is still substantially red hot, with the aid of lances, bars and similar tools and pushing the bath material back into the molten bath. Considering the high prevailing temperatures, this naturally is a laborious and highly inconvenient operation. Moreover, due to the coarse lumps of bath material which remain in the bath or are pushed back into the same during rough cleaning, the insertion of fresh anodes is made difficult. The residual anodes which have been pre-cleaned in this manner are first stored in racks and after cooling are conveyed to a cleaning station, where fine cleaning is conducted, and that again manually with the aid of cleaning tools and pressurized air. Due to the formation of dust this also is rather uncomfortable work.

The invention is based on the objective of improving the method and, respectively, the apparatus used therein so that it is more comfortable and yet economical.

The invention resides in that the residual anode is rotated in the cleaning station and is exposed as a rebound plate to a flow of striker bodies which knock the bath material off the residual anode.

In this embodiment of the method according to the invention the striker bodies, which are especially balls of ferromagnetic material such as steel, strike upon all portions of the residual anode, because the latter rotates, whereby the conventional method steps of pre-cleaning and principal cleaning are combined to a single method step so that manual processing will not be required anymore. Such automation of the cleaning step makes the cleaning operation much more comfortable and in particular more economical when the knocked off bath material is recovered to be reused.

This embodiment of the invention is particularly advantageous when the residual anode disposed in the cleaning station is pivoted from a suspended position within a cleaning chamber to an inclined position so that the residual anode with the rebound surfaces to be cleaned projects from the cleaning chamber and enables free-falling striker bodies to strike or hail thereon. The flow of striker bodies and knocked off pieces of bath material is subsequently separated, especially in a separator, such that bath material of sufficiently small particle size may be returned to the electrolytic cell, while after separation the striker bodies are separated from the coarser lumps of bath material and may be returned to the falling flow of striker bodies; the coarser lumps of bath material are in turn crushed and recovered for reuse.

The apparatus according to the invention is provided with rotary drive means for the residual anode to rotate the same within the cleaning station, while a pivoting mechanism pivots the residual anode into the falling flow of striker bodies. No manual operation of tools is required to knock bath material off the residual anode; it is sufficient to provide for removal of the residual anode from the electrolytic cell, for transport thereof into the cleaning station or cleaning chamber, respectively, and for rotation of the residual anode following pivoting; to this end suitable drive or rotating and pivoting mechanisms are provided which may be controlled either by push-button actuation or even fully automatically.

A particularly advantageous embodiment of the invention will be described hereinbelow with reference to the drawing. The FIGURE is a schematic flow diagram illustrating the process when an arrangement for cleaning a residual anode is employed in the cleaning station.

By means of an endless chain transporter 17 serving as transport means the suspension assembly for the residual anode 1 is transported into the suspended position shown in dash-dot lines within the cleaning chamber 16, where a pivoting mechanism 13 causes the residual anode 1 including the suspension assembly and the rotary drive means 2 to be pivoted to the inclined position indicated in full lines; the angle of rotation $\alpha$ relative to the normal is about 45°. The residual anode 1 is outside of the cleaning chamber 16, because it is pivoted through the window **16*a* of the cleaning chamber 16 into the falling flow 14 of striker bodies 11. The rotary drive means 2 causes the residual anode 1 to rotate, so that the surface thereof serves as rebound plate for the free-falling striker bodies 11, which consist of ferromagnetic steel balls. A guide means 6, which is in the form of a guide chute, is disposed approximately 4 m above the residual anode 1 in the inclined position thereof, so that the striker bodies 11 possess sufficient kinetic energy for knocking bath material off the residual anode 1** when striking thereon. The rotation need not be performed at high speeds; a speed of rotation of 12 r.p.m. will suffice. The striker bodies have a diameter of about 6 cm.

Having knocked bath material 12 off the residual anode 1, the striker bodies 11 together with the knocked off bath material slide downwards onto a screen 7 having such a mesh size that the striker bodies 11 and coarser lumps of bath material 12 will not pass through the screen but only smaller-sized bath material **12*a* will pass therethrough. By means of a bucket conveyor said smaller-sized bath material 12*a* is conveyed to a collecting bin 15**, whence it may again be supplied to electrolytic cells.

The coarser bath material 12 together with the striker bodies 11 is conveyed via a surge bin to a bucket elevator 9, whence it is pulled up to the charging bin 4 from which the mixture comprising the striker bodies 11 and the coarser bath material 12 is transported by means of a conveying trough 3 to the magnetic separator 5, which deflects the striker bodies 11 towards the guide means 6 while the coarser lumps of bath material 12 are conveyed to a roll-type crusher 10 which crushes said lumps to bath material **12*a* of small particle size; said small particles then slide downwards along the inclined wall and after meeting the striker bodies 11 and freshly knocked off bath material 12 pass through the screen 7 into the bucket conveyor 8**.

This especially preferred embodiment of the invention shows that the process and the apparatus may not only be operated fully automatically but are also extremely economical, because practically none of the materials will be lost, so that the invention ensures a considerable technical advance in this special technical field. It is thereby possible to prevent health hazards caused by working in excessive heat environment during the pre-cleaning step and by heavy dust emission.

I claim:

1. A method of cleaning residual anodes employed for fused-salt electrolysis, in which the residual anode is removed from the electrolytic cell and is guided into a cleaning station, and in which bath material from the electrolytic cell that has remained on the residual anode is mechanically removed therefrom and is optionally returned to the fused-salt electrolysis, characterized in that the residual anode (1) rotates within the cleaning station and is exposed as a rebound plate to a flow of striker bodies (11) which knock the bath material (12) off the residual anode (1).

2. A method as claimed in claim 1, characterized in that the residual anode (1) within the cleaning station is pivoted to an inclined position and is exposed to a flow of falling striker bodies (11).

3. A method as claimed in claim 1 or claim 2, characterized in that the striker bodies (11) are balls of ferromagnetic material and are magnetically separated from knocked-off bath material (12).

4. A method as claimed in claim 3, characterized in that the bath material (12) after separation is crushed by the striker bodies (11).

5. A method as claimed in claim 4, characterized in that the bath material (12) is crushed to a particle size of less than 50 mm.

6. An apparatus for cleaning residual anodes employed for fused-salt electrolysis comprising transport means for transporting a residual anode from the electrolytic cell to a cleaning station and cleaning means for at least mechanically cleaning said residual anode of bath material adhering thereto from said electrolytic cell, characterized in that the cleaning means comprise striker bodies (11) and a rotary drive means (2) for rotating the residual anode (1) into a cleaning position within a path of flow (14) of said striker bodies (11), and including a pivoting mechanism (13) for pivoting the residual anode (1) into and out of said cleaning position.

7. An apparatus as claimed in claim 6, characterized in that falling flow (14) initiates from guide means (6) disposed a few meters above the residual anode (1) which is in its inclined position pivoted about a pivot angle $\alpha$ of about 45° relative to the vertical, a magnetic separator (6) being disposed upstream of said guide means for separating the ferromagnetic striker bodies (11) from entrained bath material (12).

8. An apparatus as claimed in claim 7, characterized in that a roll-type crusher (12) crushes knocked-off bath material (12).

9. An apparatus as claimed in claim 8, characterized in that a screen (7) classifies the crushed bath material (12*a*) together with freshly knocked off bath material (12) and the striker bodies (11) such that crushed and small-sized bath material may be returned via a bucket conveyor (8) to be reused in an electrolytic cell, whereas coarse bath material (12) and the striker bodies (11) may be supplied via a bucket elevator (9) to the magnetic separator (5).

10. An apparatus as claimed in claim 9, characterized in that the cleaning station is provided with a cleaning chamber (16) including a window (16*a*) through which the residual anode (1) may be pivoted into the falling flow (14) of striker bodies (11).

* * * * *